United States Patent [19]

Domning

[11] Patent Number: 4,460,441

[45] Date of Patent: Jul. 17, 1984

[54] EXPANDED METAL AS MORE EFFICIENT FORM OF SILVER CATHODE FOR ELECTROLYTIC REDUCTION OF POLYCHLOROPICOLINATE ANIONS

[75] Inventor: William E. Domning, Walnut Creek, Calif.

[73] Assignee: The Dow Chemical Company, Midland, Mich.

[21] Appl. No.: 413,404

[22] Filed: Aug. 31, 1982

[51] Int. Cl.[3] ..... C25B 3/04; C25B 11/03; C25B 11/06

[52] U.S. Cl. ..... 204/73 A; 204/73 R; 204/74; 204/284; 204/286; 204/288

[58] Field of Search ..... 204/283–285, 204/73 R, 73 A, 74–77, 286, 288

[56] References Cited

U.S. PATENT DOCUMENTS

| | | | |
|---|---|---|---|
| 1,792,998 | 2/1931 | Melish | 204/285 |
| 2,616,845 | 11/1952 | Kreml | 204/284 |
| 3,816,293 | 6/1974 | Ueda et al. | 204/284 |
| 3,859,197 | 1/1975 | Bouy et al. | 204/284 |
| 4,217,185 | 8/1980 | Kyriacon et al. | 204/73 R |
| 4,242,183 | 12/1980 | Kyriacon | 204/73 R |

FOREIGN PATENT DOCUMENTS

| | | | |
|---|---|---|---|
| 804660 | 10/1936 | France | 204/284 |
| 1433970 | 4/1976 | United Kingdom | 204/284 |

OTHER PUBLICATIONS

"The Cost of Electrochem. Cells", AIChE Symp. 185; Electroorganic Synthesis Tech., pp. 76–88, vol. 75, 1979, Krumpelt et al.

*Primary Examiner*—R. L. Andrews

[57] ABSTRACT

Commercial scale production of 3,6-dichloropicolinic acid by the reduction of tetrachloropicolinic acid in basic aqueous solution at a silver cathode is made economically feasible by utilizing as the cathode an expanded silver sheet wrapped around a backing board.

8 Claims, 2 Drawing Figures

EXPANDED METAL AS MORE EFFICIENT FORM OF SILVER CATHODE FOR ELECTROLYTIC REDUCTION OF POLYCHLOROPICOLINATE ANIONS

BACKGROUND OF THE INVENTION

U.S. Pat. No. 4,242,183 discloses a highly active silver cathode having utility for the stepwise electrolytic reduction of pentachloropyridine to 2,3,5-trichloropyridine. U.S. Pat. No. 4,217,185 discloses the use of the same cathode for the stepwise reduction of tetrachloropicolinate anions to 3,6-dichloropicolinate anions—which are readily converted to 3,6-dichloropicolinic acid, an increasingly important herbicide.

The foregoing patents teach that the silver cathode (which must be activated, as by anodization) may be a monolithic silver conductor or a silver-plated conductor. The conductor can be of any configuration—such as a screen, plate, rod, etc. A cylindrical cathode—such as a cylindrical, 20-mesh, silver (wire) screen—is generally preferred and the cathode utilized in the pilot plant example described in the '185 patent was a planar, 20-mesh, silver wire screen, bolted against a wall of a plastic cell body.

A high ratio of absolute to projected planar surface areas—a well known desideratum for any electrode—is afforded by the wire screening configuration. However, such screening is a more expensive form of silver and would require a quite substantial capital investment if employed in a commercial scale electrolytic plant. Thus, alternative, possibly less expensive configurations of comparable absolute surface areas were considered—with due regard for the well known fact that other configuration-determined factors, such as the shape and size of openings, "edge" effects, etc., can strongly affect the activity, selectivity and efficiency of the electrode.

The cost of electrolytic plants based on plate and frame cells designed for continuous, flow-through operation were estimated by K. B. Keating and V. D. Sutlic to be substantially lower when expanded metal sheet electrodes (anodes and cathodes) were employed, rather than solid plate electrodes: *The Cost of Electrochemical Cells, AIChE Symposium* 185, *Electro-organic Synthesis Technology,* pp. 76–88, Vol. 75 (1979). Cells utilizing expanded metal electrodes were indicated to be more economical to fabricate and assemble. (This is largely attributable to the fact that the expanded metal electrodes could be exposed on both sides to the electrolyte—thereby affording full utilization of their 70–80% higher actual surface areas—whereas, in the plate and frame design used, solid electrodes would be exposed on one side only. Some advantage was also indicated for the turbulence promoting effects of the expanded metal configuration on gas release from the electrolyte. Wire screen type electrodes of course would be advantageous over solid electrodes in the same respects but would generally be more expensive than expanded metal sheets.

Both screens and expanded metal sheets are foraminous and therefore must be thicker than solid sheets in order to maintain an adequately low ohmic resistance through the electrode. However, this is not a significant cost factor when relatively inexpensive expanded metals of the type mentioned by Keating and Sutlic may be used.

Among the several known electrolytic cell types, a plate and tank cell design was selected as most suitable for manufacture of 3,6-dichloropicolinic acid. In this type of cell, both sides of whatever type of generally planar electrodes can usually be exposed to the electrolyte and foraminous electrodes ordinarily offer no advantage in this respect. Nevertheless, the higher actual surface areas afforded by screens and expanded metals is still an important desideratum.

Expanded silver sheet is available and is about half as expensive as silver wire screening of comparable dimensions and ohmic resistance. However, it is also so "limp-"—at least as a monolithic sheet—as to require support by a backboard when of a size appropriate for use as an electrode in a commercial scale cell. This not only requires use of cell space to accommodate the backboards but also results in less than full utilization of the surface area of the expanded metal, due to contact between it and the backboard. Furthermore, the actual surface area of an expanded metal mesh is only about 60% of that for the same size sheet of comparable mesh wire screening.

Finally, there is the question—in view of the differences between the shapes of the openings and the elements defining them in the two forms—as to whether the expanded form (once activated) would perform as well as a cathode for the reduction of polychloropicolinate anions. For example, the expanded metal pattern (see FIG. 1B of the drawings) necessarily will result in a somewhat lower degree of field uniformity between electrode/counter electrode pairs than when a screen-form electrode is used; according to an experienced electrochemist (D. K. Kyriacou; *Basics of Electroorganic Synthesis,* page 15; John Wiley and Sons, N.Y., N.Y. 1981), uniformity in the distribution of the electric field between the electrodes is not only very desirable but often is essential for efficient operation and for avoidance of over (or under) reduction. The possible importance of even small differences in this regard is made amply evident by the discussion of field effects at page 103 of the same book. Thus, it cannot be presumed that the expanded form of silver is inherently as active and selective as the wire screen form. Further, the cost advantage of the expanded form would appear to be largely or even completely counter-balanced by the higher effective surface area and greater rigidity of the screen form. Some further advantage for the expanded form would then need to be apparent before it could be considered a viable alternative to the screen form.

Such an advantage has now been discovered. The expanded metal form silver electrode is considerably more active than the screen form. That is, on an absolute surface area basis, the voltametric current density exhibited by an activated, expanded silver electrode immersed in a 1% aqueous sodium tetrachloropicolinate solution is about 5 times that exhibited by a comparable screen-form electrode in the same solution, under the same potential. In practical terms, this translates to at least a 59% higher rate of production of 3,6-dichloropicolinic acid ("3,6-D", henceforth) per dollar of cell cost. A difference of this magnitude in production rate is highly significant to the economic feasibility of commercializing any process.

OBJECTS OF THE INVENTION

The primary object of the invention is to provide a more practical alternative to screen-form silver electrodes for the manufacture of 3,6-D by electrolytic reduction of tetrachloropicolinic acid.

A further object is to provide an electrode and backing board assembly which makes it possible to utilize the expanded metal form of silver as said alternative electrode on a commercial scale.

An additional object is to improve the economic viability of 3,6-D manufacture by an environmentally clean process.

Another object is to provide a more active silver cathode.

Still other objects will be made apparent to those knowledgeable in the art by the following specification and claims.

SUMMARY OF THE INVENTION

The present invention is the use of an expanded silver sheet as a cathode for the electrolytic reduction of polychloropicolinate anions. The invention also comprises an electrode assembly which includes an expanded silver sheet and is suitable for use as the cathode in a commercial scale cell.

The reduction process may be more specifically defined as the improvement in the process of electrolytically reducing polychloropicolinate anions in a basic aqueous medium at an activated silver cathode wherein said cathode is an expanded silver sheet.

The electrode assembly of the invention may be more specifically defined as an electrode assembly comprising a platelike supporting member having two opposed faces, an expanded silver sheet generally coextensive with said member, a current collecting/distributing means and a fastening means, said sheet being conductively connected to said collecting means and joined by said fastening means to said member in a fixed position, uniformly closely adjacent to said faces.

Preferably, in the foregoing assembly, the supporting element is a polypropylene or fiberglass/epoxy composite board, the expanded sheet is disposed as a wrap around the board and is uniformly in light contact therewith except along one edge of the board against which it is compressed by a flat, silver bar interposed between said edge and a stiff compression bar bolted to the board through the silver bar, which is welded to a silver rod extending through the compression bar away from the rest of the assembly. The two bars, the bolts and the rod constitute said collecting means. In this embodiment of the invention, the fastening means comprises the latter bolts and preferably also include a number of soft rivets—preferably plastic rivets.

BRIEF DESCRIPTION OF THE DRAWINGS

FIG. IA is a perspective view depicting an electrode assembly constituting the above-described preferred embodiment of the invention. The assembly comprises a composite backing board, an expanded silver sheet wrapped around it and fastened to it by plastic rivets, and a bolted-on, sub-assembly which comprises a compression bar, a silver bar and a silver rod and functions as a current collecting/distributing means.

DETAILED DESCRIPTION

Sheet silver in expanded form (made by die-slitting and stretching perpendicularly to the slit lines) is available from Exmet Corporation, 355 Hanover St., Bridgeport, Conn., U.S.A. It may be ordered in the ranges of dimensions tabulated below. Reference may be had to Figure 1B of the drawings for the meaning of the following dimensional symbols, as used in the Table. $T_s$ is the thickness of the strands (defining the generally diamond-shaped openings) and is equal to the thickness of the silver sheet before it was expanded. $W_s$ is the strand width, SWD is the "short way" distance across the diamonds and LWD is the "long way" distance across them—the latter two distances being measured from center-to-center of the intersections of the strands.

DIMENSIONS OF EXMET CORP. EXPANDED METAL SIZES

| Size | LWD | SWD Min. | SWD Max. | $T_s$ Min. | $T_s$ Max. | $W_s$ Min. | $W_s$ Max. | Mesh (# Openings/in$^2$) |
|---|---|---|---|---|---|---|---|---|
| 1 | 0.405" | 0.20 | 0.23" | 0.003 | 0.025" | 0.007 | 0.055" | 25 |
| 1/0 | 0.280 | 0.10 | 0.125 | 0.003 | 0.025 | 0.007 | 0.055 | 65 |
| 2/0 | 0.187 | 0.077 | 0.091 | 0.002 | 0.020 | 0.007 | 0.035 | 120 |
| 2/0E | 0.187 | 0.048 | 0.071 | 0.002 | 0.010 | 0.007 | 0.035 | 170 |
| 3/0 | 0.125 | 0.050 | 0.065 | 0.004 | 0.020 | 0.004 | 0.020 | 300 |
| 4/0 | 0.077 | 0.038 | 0.046 | 0.004 | 0.020 | 0.004 | 0.020 | 625 |
| 5/0 | 0.050 | 0.026 | 0.030 | 0.004 | 0.012 | 0.004 | 0.012 | 1400 |
| 6/0 | 0.031 | 0.021 | 0.024 | 0.004 | 0.010 | 0.004 | 0.010 | 2600 |

Sizes 1 through 3 are available in 18" wide rolls and sizes 4 through 6 in 16" wide rolls, the LWD always being crosswise of the roll. The method of specifying the expanded metals is by giving in sequence the sheet thickness ($T_s$) in mills, the chemical symbol for the metal (Aq for silver), the strand width ($W_s$) in mills and the size ("mesh designation"): 5 Ag 7–5/0, for example.

Figure 1A:
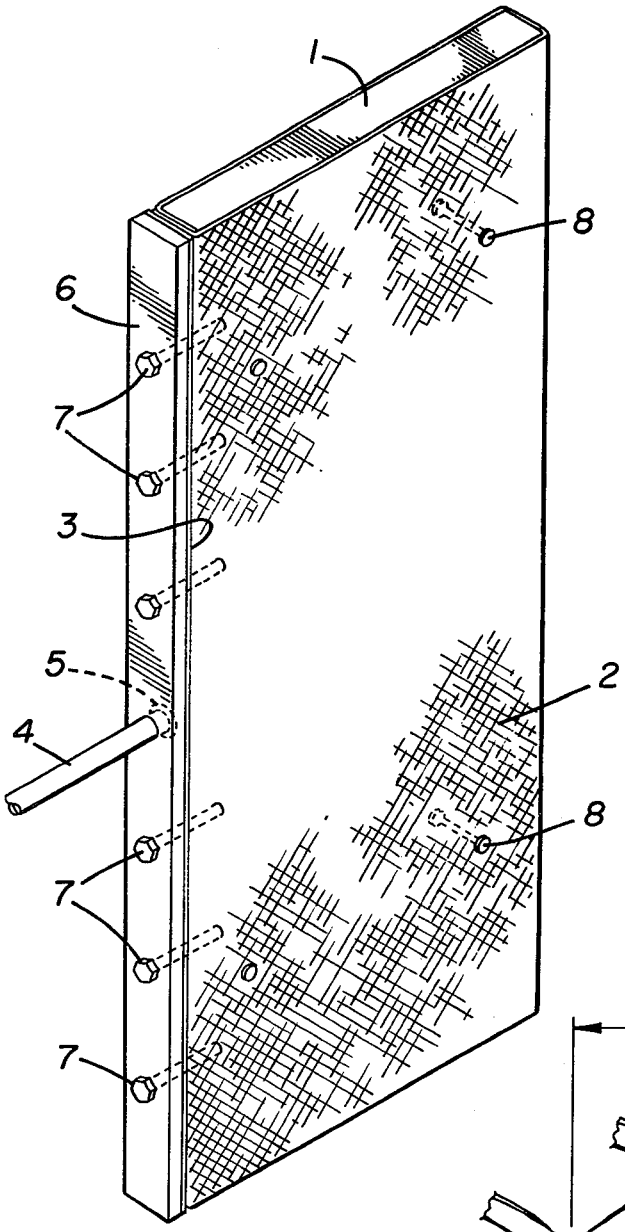
FIG. 1B is a magnified perspective view of a portion of the expanded silver sheet, seen obliquely from above at about a 45° angle to the horizontal.
Figure 1B:
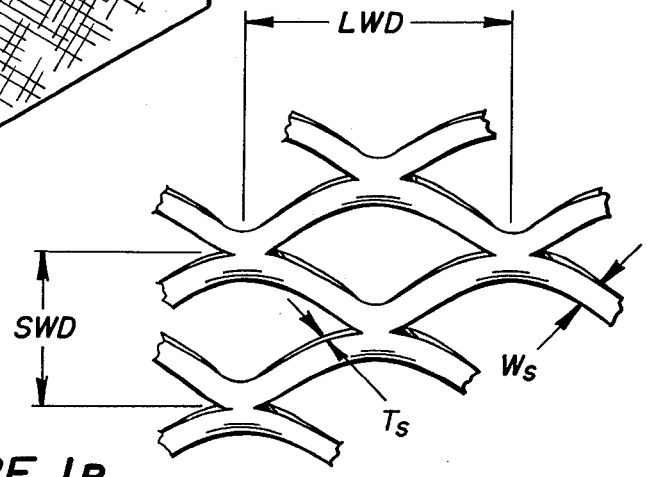

Referring to FIG. 1-A, the preferred version of the electrode assembly will now be described. A polypropylene backboard (1) of rectangular platelike shape is conformingly wrapped with a piece (2) of expanded silver sheet which is as wide as the height of the backboard and terminates in overlapping end-flaps (not separately numbered) which are disposed between the left edge of the backboard and a thin silver bar (3) to which is attached a silver rod (4) by an annular weld bead (5), shown in phantom. The bar—which is somewhat annealed as a result of the welding—is urged against the end flaps of the silver sheet by an overlying stainless steel compression bar (6) attached to the backboard by a series of six stainless steel bolts (7) passing through aligned holes (not numbered) in bars (3) and (6) and threaded into tapped bores (not numbered) in the backboard. A series of plastic rivets (8; only a few shown) passing through the backboard from face to face (not numbered) serves as an additional fastening and positioning means for the silver sheet. Rod (4) extends from the silver bar (3) through a close-fitting bore (not numbered) in bar (6) which is countersunk at its inner end to accommodate the weld bead (5). Although the expanded sheet is not spaced from the adjacent backboard surfaces, it is of such a shape that it makes essentially only minimal (point) contact with the board and most of its inner surface is accessible to electrolyte contact.

The use of a soft silver bar in compressive contact with the expanded (work hardened) silver is considered a highly preferable way of establishing an adequately low resistance electrical connection to the electrode. The expanded silver is so thin and flimsy that it is difficult to weld a conductive lead to or to hold in good contact with a wire, however intertwined with the strands of the mesh.

Welding a silver rod to the bar provides a corrosion-proof contact with a conductive lead which can be passed—by means of a conventional seal assembly—through a cell wall.

The use of a plastic riveting material is distinctly advantageous in that a number of suitable plastic materials can be worked at low temperatures and in a manner such that the expanded silver will not be damaged by the riveting procedure. It has been found possible to fasten the metal firmly to the backboard, even though a plastic rivet will not contract when cooled after forming. That is, when the rivet heads are formed, the plastic material flows through the openings in the expanded metal sheet and becomes interlocked with it upon cooling.

The riveting procedure, as employed with a ½" thick, backboard, is as follows. A ⅞" length of ⅛" diameter polypropylene rod is placed in a ⅛" hole, ¾" deep, in a metal bar and the protruding ⅛" of the rod is "mushroomed" to the surface of the bar with a concave, bronze die, kept at the melting point of the polypropylene by a thermostatically controlled heating element. The resulting single-headed unit is then inserted through the expanded metal on one face of the backboard into a ⅛" bore through the backboard and through the expanded metal on the opposite face of the board. The already-formed rivet head is supported and heat and pressure applied, with the same die, to the protruding ⅛" to 3/16" of the rod, thereby forming the second head of the rivet.

The platelike supporting member of the electrode assembly can be fashioned from any suitably rigid material which will not detrimentally react with any of the reactants or products it will contact in use in an electrolytic cell. Thus, although polypropylene materials of the above-described type are preferred, the use of other materials such as inert ceramics or even metals (preferably silver plated) is considered feasible.

The process of the present invention is practiced essentially according to U.S. Pat. No. 4,217,185—the disclosure of which is incorporated herein by reference for all purposes which may legally be served thereby. However, the expanded metal form of the silver cathode disclosed herein is employed (in place of the foil or wire screen forms of silver cathode used in the examples in the patent). Preferably, the cathode is comprised in an electrode assembly as above defined which is one of a number of such assemblies disposed in alternating array with a like number of generally co-extensive, platelike counter electrodes (anodes) in a plate and tank type, full-scale cell adapted for circulation of a basic, aqueous solution of a polychloropicolinic acid salt through it and provided with means for distributing the solution flow evenly to the spaces between the electrodes.

The expanded silver electrode is activated in the manner described in the '185 patent (and in U.S. Pat. No. 4,242,183—the disclosure of which is also incorporated herein by reference).

The following examples are for purposes of illustration and are not to be construed as limiting the scope of the present invention in a manner inconsistent with the claims appended to these specifications.

EXAMPLES

Example 1—Comparison of Different Silver Cathode Configurations

The following experiment was made to compare the cathodic activities of foil, wire screen, expanded metal and loose-woven mesh configuration silver electrodes.

Two rigid, rectangular, polypropylene blocks about ½" thick were bolted together, drilled through with a ⅝" bit and unbolted. The test electrode specimen was formed as a disc, about 1" in diameter, with a "handle" about ¼×3" long extending from it as an electrical lead. An annular band of a silicone sealant about ⅛" wide was applied to each face of the disc, which was then clamped between the blocks so that the uncoated portion of it was exposed in the bore through the blocks, the unexposed portion being made electrolyte-inaccessible by the sealant.

The loose-woven mesh specimen was prepared as follows: an ordinary pot-scrubber formed by gathering a double-walled sleeve, woven from 2 mil×25 mil copper ribbon, into a ball, was "ungathered" and the resulting sleeve electroplated with silver. The sleeve was then flattened and folded several times (until the openings through the resulting compressed wad were judged about equal in size to the openings in a 20-mesh wire screen). The specimen was then cut out of the wad in the above-described shape. The actual electrolyte-accessible area of the specimen was determined, after testing, by carefully cutting out the exposed portion of the still mounted specimen, weighing it and multiplying by the surface area to weight ratio determined for a single length of ribbon unravelled from the silvered sleeve.

The electrolyte-accessible surface areas of the screen and expanded metal specimens were calculated from their dimensions. The screen was a square pattern, 20-mesh (400 openings per in$^2$) screen formed from 16 mil silver wire and had an actual to projected surface area ratio of 2.52 to 1. The expanded metal had a strand thickness of 8 mils, a strand width of 10 mils and 625 openings per in$^2$ (Exmet designation 8 Aq 10–4/0; see Table 1). The ratio of actual to projected areas for the expanded metal was 1.38.

A single compartment beaker-cell comprising a test cathode, a platinum anode and a saturated calomel reference electrode was used, the anode being positioned relative to the cathode such that the difference in front-side and back-side currents was essentially nil. The cell was connected to a Princeton Applied Research (PAR) Model 173 potentiostat equipped with a PAR Model 175 Universal programmer and a Huston Instruments Model RE0074 X-Y recorder.

The test cathode was activated in 2% aqueous NaOH by repeated anodizations, i.e., by cycling it five times between potentials (relative to the reference electrode) of +1.0 volts and −1.0 volts, at a rate of 5 millivolts per second. Cycling was discontinued at the −1 volt limit and the cell contents replaced with a 2% solution of "tet-acid" (tetrachloropicolinic acid) in 2% aqueous NaOH. Voltage/current curves were then recorded by scanning from an initial cathode potential of 0.0 volts to a potential of −1.8 volts, at a rate of 5 mV per second. Current onset was at −0.9 volts. The current at −1.4 volts (and the projected and actual surface areas of the cathode) was used to calculate the nominal and actual current densities for each test cathode.

The test data are given in Table 1, below.

TABLE 1

| Test Cathode | Surface Area Projected[1] | Surface Area Actual | Current (mA) | Current Density (mA/in²) Nominal | Current Density (mA/in²) Actual |
|---|---|---|---|---|---|
| Foil | 0.307 in² | 0.614 in² | 23 | 74.91 | 37.46 |
| Screen | 0.307 | 0.775 | 18 | 58.63 | 23.23 |
| Exp. Metal | 0.307 | 0.423 | 50 | 162.87 | 118.20 |
| Loose Mesh | 0.307 | 1.580 | 45 | 146.58 | 28.48 |

NOTE:
[1]Area of either face of planar electrode disc ½" in diameter.

The ratio of cell currents (at −1.4 volts) with the expanded metal- and screen-form cathodes was 50/18=2.78. In other words, the rate of reduction of tetrachloropicolinate ions (to trichloropicolinate ions) at the expanded metal was 2.78 times the rate at the screen.

Example 2—Laboratory Scale Reductions of Tetrachloropicolinate Ions to 2,6-Dichloropicolinate Ions with Screen and Expanded Metal Form Silver Cathodes A cell was assembled from a 200 ml beaker, a Teflon-coated magnetic stirring bar, a cylindrical silver cathode (20 mesh, 16 mil wire screen or 8 Aq 10–4/0 expanded metal; projected area 16 in²), an anode rod, a thermometer and a Luggin capillary fitted with a standard calomel reference electrode. The cell was set on a magnetic stirrer and charged with 108.24 grams of 7.0 wt. % caustic solution (mercury grade NaOH in reverse osmosis-purified water).

The cathode was activated by anodization for 12 minutes at a relative potential gradually raised from 0.0 to +0.7 volts and the potential was then decreased gradually to a final value of −1.3 volts. 11.76 Grams (0.0451 gram moles) of tet-acid was added portionwise over a period of about 2 hours by withdrawing a portion of cell liquor, masticating about a 3 gram portion of the tet-acid with it and returning the resultant slurry to the cell. The reduction was continued (at a temperature of 25°–29° C. and a cathode potential of −1.3 volts) until the cell current dropped to about 0.6–0.7 amps.

The cell liquor (pH∼13) was filtered by suction through celite, acidified with aq. HCl to pH∼1 and extracted with $CH_2Cl_2$ repeatedly. The combined extracts were dried over anhydrous $Na_2SO_4$, filtered and stripped at reduced pressure. The solid residue was weighed and analyzed by Gas Liquid Partition Chromatography against known standards. The current efficiency for the reduction was calculated from the yield of 2,6-D and the coulomb count (obtained from a cumulative counter in the power circuit).

A comparison of results obtained with the screen and expanded metal-form cathodes in otherwise essentially identical runs by the foregoing procedure are given in Table 2.

TABLE 2

| Cathode Form | Total Reaction Time (Hours) | Material Balance % | Current Efficiency % | Product % Theor. Yield | Composition 3,6-D | Composition 4,5-D[(1)] | Composition Mono[(2)] |
|---|---|---|---|---|---|---|---|
| Screen | 2.65 | 100.3 | 74.8 | 98.5 | 99.7 | 0.2 | 0.4 |
| Exp. Metal | 2.25 | 100.0 | 75.3 | 99.0 | 99.8 | 0.2 | — |

NOTES:
[(1)]4,5-Dichloropicolinic Acid
[(2)]Monochloropicolinic Acids.

It is apparent from the Table that the expanded metal cathode was as good or better in other respects than the screen and gave an 18% higher average reaction rate.

Example 3—Effect on Reaction Rate of Differences in Dimensions of Expanded Metal-form Silver Cathodes A series of laboratory scale reductions of tet-acid with three different sizes of expanded silver was carried out. Although other variations were also involved, the differences in rate observed for the best run with each size are believed to be largely attributable to the size effects. The experimental set-up and procedure were generally the same as in the preceding example. The results are given in Table 3 below.

TABLE 3

| Expanded Silver Size | Expanded Silver Openings Per In² | Total Reaction Time | Material Balance % | Product % Yield | Composition 3,6-D | Composition 4,5-D | Composition Mono |
|---|---|---|---|---|---|---|---|
| 2 Aq 6-6/0 | 2600 | 3.83 Hrs. | 99.91 | 97.36 | 99.04 | 0.270 | 0.600 |
| 5 Aq 10-4/0 | 625 | 3.16 | 99.59 | 98.49 | 98.49 | 0.327 | 0.771 |
| 8 Aq 10-4/0 | 625 | 3.25 | 99.19 | 99.19 | 100- | — | — |

NOTE:
The current efficiencies in these runs were closely comparable (∼75–76%).

It was not possible to make a comparison with a finer mesh silver screen; silver wire screening having on the order of 2000 openings per in² is not available. However, it is believed that even the 2 Aq 6–6/0 expanded metal would exhibit greater activity than a comparable mesh screen. 10 Aq 10–4/0 expanded metal is more rigid, longer lived and has a higher actual to projected surface area than 8 Aq 10–4/0 and is accordingly now preferred.

Example 4—Pilot Plant Scale Comparison of Screen and Expanded Metal Form Silver Cathodes Two series of experimental tet-acid reductions were carried out in an electrolytic cell comparable in scale to that described at column 20 of the above-referenced '185 patent. In the first series (33 runs), a 20-mesh, 16 mil silver wire cathode was used. In the second series (at least 40 runs) a cathode of the same nominal size but consisting of 8 Aq 10-4/0 expanded silver was used. In both series of runs, the tet-acid (1.4 gram moles) was charged to the cell all at once, as a 2% solution in 2% aqueous NaOH. The runs within each series were varied in some respects but the maximum rate (maximum cell current) attainable with the screen form cathode was only 46 amperes, as compared to 109 amperes with the expanded metal cathode; a ratio of 2.37 in favor of the latter.

The corresponding maximum production rates were about 0.10 and 0.24 lbs. of 3,6-D per hour per square foot of cathode surface (nominal). The best overall average production rate—which drops off as the (batch) reduction proceeds—with the expanded form cathode was about 0.19 lbs. per hour per $ft^2$, vis-a-vis about 0.10 with the screen cathode.

In both series of runs, the cathodes were edge-supported only; no backboards were used.

Example 5—Typical 3,6-D Production Run in Cell with Expanded Silver Cathode

A prototype, production-scale cell was set up with a total of five parallel-connected, 4'×11" expanded silver (8 Aq 10-4/0) cathodes, supported by composite backboards of the preferred type described earlier herein. The total nominal cathode area (counting both sides of the silver sheets) was $4\times11/12\times2\times5=36.7$ $ft^2$. The cathodes were washed with aqueous HCl, rinsed with reverse-osmosis purified water and activated by anodization in a 2.4% solution of tet-acid in a 2.3% aqueous solution of NaOH (37 lbs. of 50% plant concentrate, diluted) at +0.6 volts (relative to SCE) for 1/6 hour. The solution was circulated, by means of a centrifugal pump, from the cell to a mixing tank and back, and passed from a flow distributor through the spaces (¼" spacing) between the cathodes and (six) counter electrodes of the same shape and area as the cathodes. Additional tet-acid, to make a total of 200 lbs., together with 161 lbs. of 50% NaOH, was charged to the reaction by incremental addition to the mixing tank over a period of 13 hours. The reduction was discontinued after a total time of 26½ hours and the reaction mixture was worked up.

The amount of 3,6-D in the recovered product was equivalent to about 96 percent of the theoretical yield (146.7 lbs.). The overall average 3,6-D production rate was $(0.96\times146.7)\div(26.5\times36.7)=0.145$ lbs/hr/$ft^2$. The cell current was initially 3000 amperes and dropped during the first five hours of the run to 2100 amperes.

What is claimed is:

1. The improvement in the process of reducing polychloropicolinate anions in a basic, aqueous solution at an activated silver cathode, wherein said cathode is an expanded silver sheet.

2. The process of claim 1 in which said sheet is large enough to require support in order to remain in a fixed position and is fastened to a coextensive supporting means.

3. The process of claim 1 in which said polychloropicolinate anions are tetrachloropicolinate anions or trichloropicolinate anions deriveable therefrom by reduction at a silver cathode.

4. The process of claim 3 in which said polychloropicolinate anions are reduced to 3,6-dichloropicolinate anions and are 3,4,6- or 3,5,6-trichloropicolinate anions.

5. The process of claim 1 in which said expanded sheet has the following dimesions as defined in the foregoing specifications: $T_s$ from about 8 to about 10 mils, $W_s$ about 10 mils and size 4/0.

6. An electrode assembly having utility in commercial scale cells for the electrolytic reduction of tetrachloropicolinate anions to 3,6-dichloropicolinate anions, said assembly comprising a platelike supporting member having two opposed faces, an expanded silver sheet generally coextensive with said member, a current collecting/distributing means and a fastening means, said sheet being conductively connected to said collecting means and joined by said fastening means to said member in a fixed position, uniformly closely adjacent to said faces, said supporting means being a plastic or fiberglass composite board having an edge pierced by a number (n) of threaded bores extending into the board, said current collecting means comprising n bolts, a stiff compression bar, pierced through by n+1 bores, a flat silver bar pierced through by n bores and a silver rod welded to the silver bar, said sheet being disposed as a wrap around said board, in uniformly light contact therewith except along said edge of the board, against which it is compressed by said silver bar, the latter bar being interposed between the compressed portion of the sheet and said compression bar with said rod extending through one of said n+1 bores and said bolts passing through the remaining bores in the two bars and being turned into said threaded bores with sufficient force to achieve said compression.

7. An assembly as in claim 6 wherein said sheet is fastened to both of said faces by a plurality of plastic rivets passing through said board and constituting said fastening means.

8. An assembly as in either of claims 6 and 7 in which said expanded silver sheet has the following dimensions, as defined in the foregoing specifications: Ts from about 8 to about 10 mils, Ws about 10 mils and size 4/0.

* * * * *